US005540002A

United States Patent [19]

Liautaud

[11] Patent Number: 5,540,002

[45] Date of Patent: Jul. 30, 1996

[54] SNOWSHOE HAVING A CLAW PLATE ON THE UNDERSIDE OF A SNOWSHOE FRAME

[75] Inventor: Jeffrey T. Liautaud, Park Ridge, Ill.

[73] Assignee: Sherpa, Inc., Burlington, Wis.

[21] Appl. No.: 380,100

[22] Filed: Jan. 26, 1995

Related U.S. Application Data

[63] Continuation-in-part of Ser. No. 239,268, May 6, 1994.

[51] Int. Cl.[6] ..... A43B 5/04

[52] U.S. Cl. ..... 36/122; 36/124

[58] Field of Search ..... 36/122, 123, 124, 36/125

[56] References Cited

U.S. PATENT DOCUMENTS

| | | | |
|---|---|---|---|
| 2,738,596 | 3/1956 | Walsh | 36/124 |
| 3,802,100 | 4/1974 | Prater | 36/124 |
| 4,271,609 | 6/1981 | Merrifield | 36/125 |
| 4,720,927 | 1/1988 | Abegg | 36/122 |
| 5,253,437 | 10/1993 | Klebahn et al. | 36/125 |

FOREIGN PATENT DOCUMENTS

| | | | |
|---|---|---|---|
| 2059819 | 8/1992 | Canada | 36/122 |

*Primary Examiner*—Paul T. Sewell
*Assistant Examiner*—Marie Denise Patterson
*Attorney, Agent, or Firm*—Michael, Best, & Friedrich

[57] ABSTRACT

A snowshoe including a perimeter frame having a horizontal center line and horizontally spaced side portions, each of the frame side portions having a width, sheet-like material extending between the frame side portions, and a cleat having an upper surface, the cleat being connected directly to the sheet-like material and not directly to the frame so that a portion of the upper surface of the cleat is adjacent to and within a distance not greater than the width of a frame side portion from one of the frame side portions and below the horizontal center line of the frame.

7 Claims, 2 Drawing Sheets

SNOWSHOE HAVING A CLAW PLATE ON THE UNDERSIDE OF A SNOWSHOE FRAME

This is a continuation in part from copending application Ser. No. 08/239,268 filed May 6, 1994, which is incorporated herein by reference.

BACKGROUND OF THE INVENTION

The present invention relates generally to snowshoes, and more particularly to a novel claw plate location enabling 10% to 15% more traction on crossing sloped inclines.

Snowshoes have traditionally been used as a convenient means to traverse relatively deep snow. The use of snowshoes has grown significantly. Vail, the largest ski resort in Colorado, reported more snowshoes sold in 1994 than cross country skis.

Conventional snowshoes have a frame which forms the perimeter of the snowshoe and is generally made of aluminum, and less frequently, wood. The perimeter frame has floatation means secured thereto comprising a closed sheet material secured at its periphery and or lacing which holds the user up sufficiently to walk in the deep snow.

When crossing an incline, the downhill snowshoe tends to kick out and slip. The user can fall. Therefore, cleats have been added generally on the decking which can be closed sheet material or lacing or both.

SUMMARY OF THE INVENTION

One of the primary objects of the present invention is to place the cleat as far to the outer edge of the snowshoe frame as possible.

A more particular object of the present invention is to provide a novel claw, or cleat, and frame combination wherein the cleat is adapted for mounting on the underside of the snowshoe frame for particular application such as crossing sloped inclines, generally termed traversing.

Another object of the present invention is to provide a snowshoe for having a novel arrangement for securing a sheet type wear pad for use under the user's heel and running transversely across the snowshoe, around the frame and back with a cleat attached so the underside of the frame meets the curved portion of the top of the cleat thereby providing rigid security, and extended cleat claw tooth protrusion in an outrigger format to prevent slippage when traversing.

In carrying out the present invention, a snowshoe is provided which, in its preferred embodiment, includes a lightweight tubular metallic frame that defines the perimeter of the snowshoe. A closed sheet like decking or floatation material is secured interiorly of the frame and enables the frame to resist downward movement into snow. The outer marginal edge of the decking is secured to the frame by a plurality of connector straps, each of which is looped about the frame and has its ends secured by a rivet, or, in the case of lacing, a cage clip. A wear pad of closed sheet like material runs transversely across the snowshoe approximately where the user's heel comes down. A cleat is riveted to the wear pad so that the curved portion of the top of the cleat meshes with the curved portion of the snowshoe frame. A binding is attached to hold the boot. The binding is mounted on a hinge rod.

DETAILED DESCRIPTION

Figure 1:
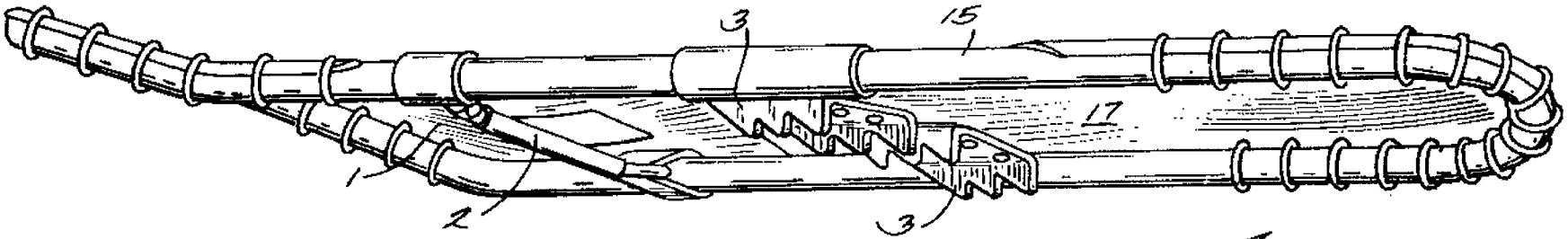
FIG. 1 is a perspective view of the bottom of the snowshoe with two cleats in place under the frame.
Figure 2:
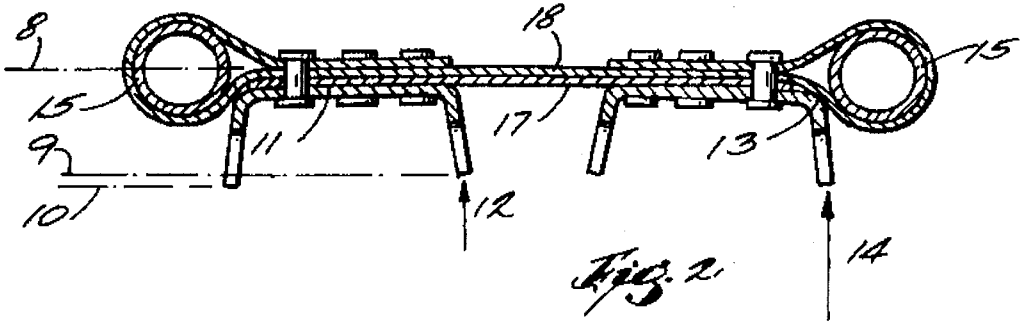
FIG. 2 is a cross sectional view of the snowshoe with two cleats in place under the frame.
Figure 3:
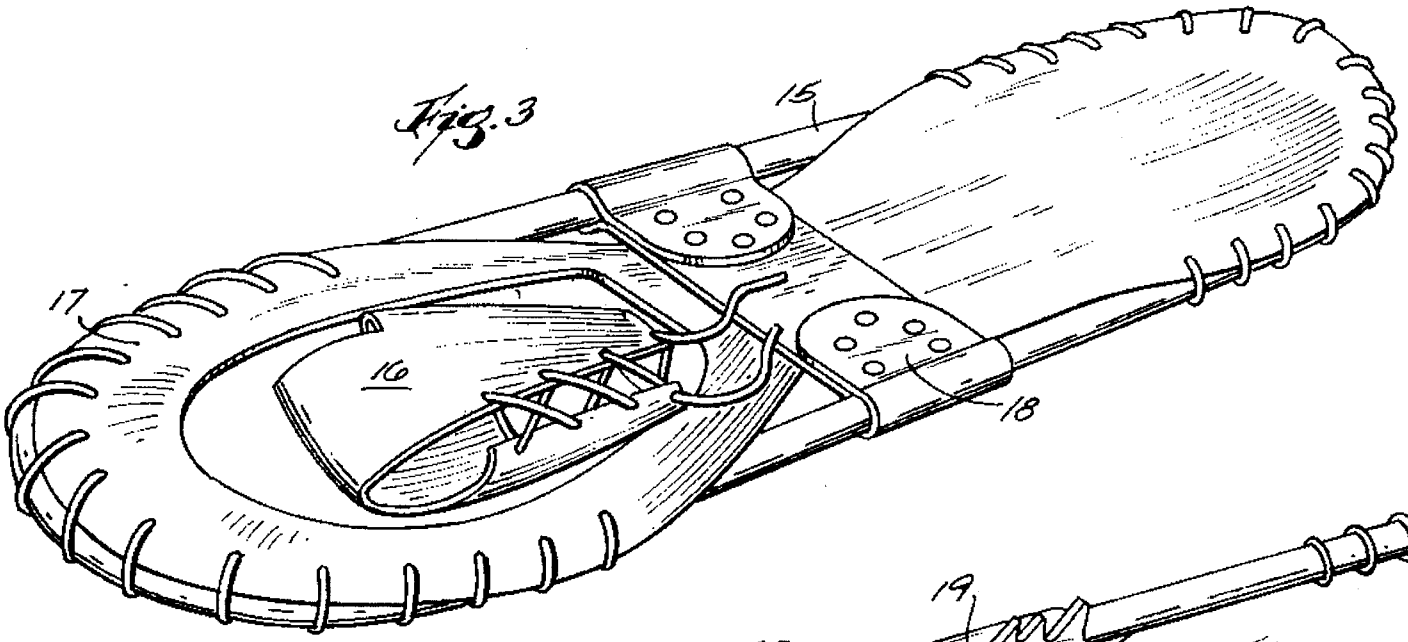
FIG. 3 is a top view of the snowshoe in perspective with binding attached.
Figure 4:
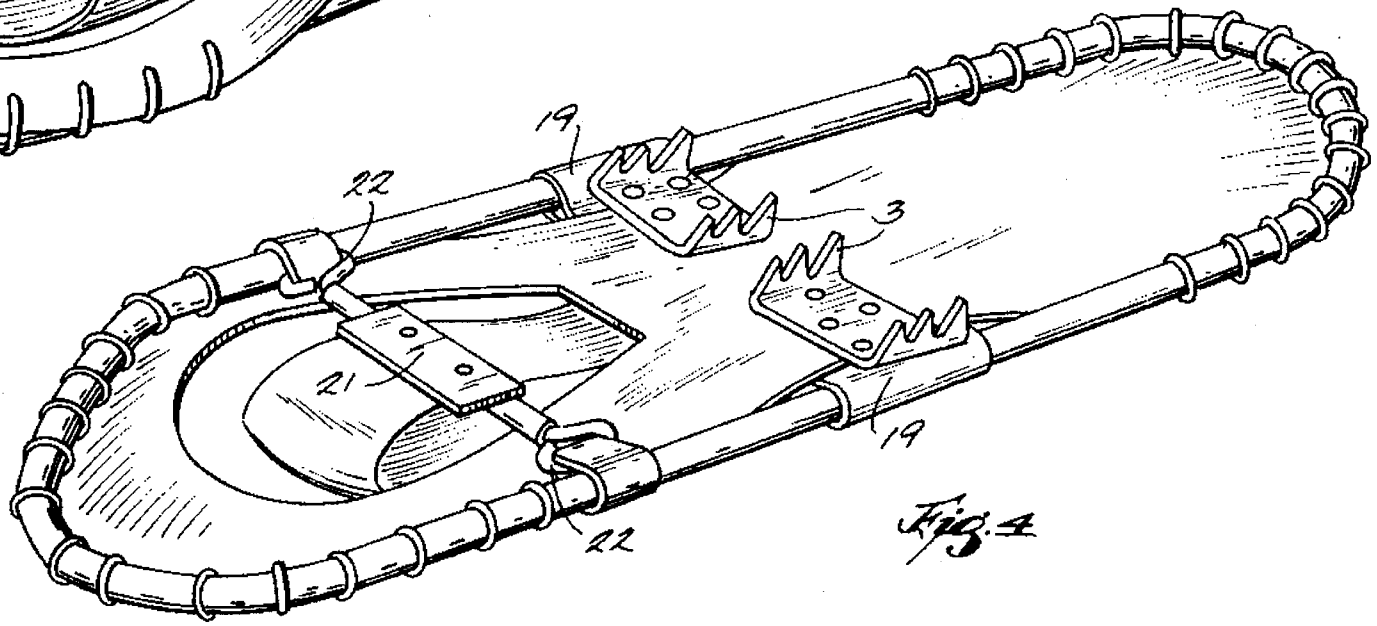
FIG. 4 is a bottom view of the snowshoe in perspective with binding attached.

Referring now to the drawings, and in particular to FIGS. 1–4, a snowshoe constructed in accordance with a preferred embodiment of the present invention is illustrated. Briefly, the snowshoe includes a perimeter frame 15 to which is affixed flotation means in the form of a closed sheet type decking material 17 that extends substantially the full length and width of the frame. Hinge rod 2 has its opposite ends 22 secured to the frame 15 so as to extend across an opening 1 in the flotation means. The binding 16 is mounted to the hinge rod with a retainer plate 21.

Turning now to a more detailed description of the snowshoe, the frame 15 is preferably made of a suitable strength, lightweight material such as aluminum, wood, plastic or fiber resin composition. The cleat 3 is made of any suitable hard material such as aluminum, titanium or steel. The cleat is attached to the snowshoe by riveting it to the wear pad 18 so that some portion of the upper surface 11 of the cleat or the rounded edge 13 of the upper surface of the cleat is adjacent to the frame and below the center line 8 of the cross section of the frame 15. The upper surface 11 of the cleat becomes rigidly affixed to the frame. Upward force 14 on the cleat teeth is translated to the entire frame of the snowshoe. Conversely, upward force on the cleat teeth 12 located inward from the frame results in a flex of the snowshoe deck. Additionally, if the two rows of cleat teeth are the same height, the row of teeth 10 under the snowshoe frame will protrude further beneath the snowshoe frame than the row of teeth 9 inward from the snowshoe frame. The cleat 3 may be attached to the snowshoe by any connector strap means 19.

I claim:

1. A snowshoe comprising in combination a perimeter frame having a horizontal center line and horizontally spaced side portions, each of the frame side portions having a width, sheet material extending between the frame side portions, and a cleat having an upper surface, the cleat being connected directly to the sheet material and not directly to the frame so that a portion of the upper surface of the cleat is adjacent to and within a distance not greater than said width from one of the frame side portions and below the horizontal center line of the frame.

2. A snowshoe as defined in claim 1 and further comprising a wear pad extending between the frame side portions on a transverse in an area corresponding to placement of a user's heel with the cleat attached to the wear pad.

3. A snowshoe as defined in claim 1 and further comprising a wear pad extending between the frame side portions for reinforcing the sheet material, and wherein the cleat is attached to the wear pad.

4. A snowshoe as defined in claim 1 wherein said one of the frame side portions has a vertical center line, and wherein the cleat is inside the vertical center line.

5. A snowshoe as defined in claim 1 wherein the cleat is located on a transverse line in an area corresponding to placement of a user's heel.

6. A snowshoe comprising a perimeter frame having horizontally spaced side portions, a sheet deck extending between the frame side portions, a sheet wear pad extending between the frame side portions for reinforcing the deck, the wear pad having opposite ends each attached to a respective one of the frame side portions, and a pair of independent cleats arranged side-by-side attached to the wear pad.

7. A snowshoe as defined in claim 6 wherein the wear pad and the cleats are located on a transverse line in an area corresponding to placement of a user's heel.

* * * * *